US006761812B2

(12) United States Patent
Preusse et al.

(10) Patent No.: US 6,761,812 B2
(45) Date of Patent: Jul. 13, 2004

(54) APPARATUS AND METHOD FOR ELECTROCHEMICAL METAL DEPOSITION

(75) Inventors: Axel Preusse, Radebeul (DE); Gerd Marxsen, Radebeul (DE)

(73) Assignee: Advanced Micro Devices, Inc., Austin, TX (US)

( * ) Notice: Subject to any disclaimer, the term of this patent is extended or adjusted under 35 U.S.C. 154(b) by 0 days.

(21) Appl. No.: 10/303,276

(22) Filed: Nov. 25, 2002

(65) Prior Publication Data

US 2004/0000485 A1 Jan. 1, 2004

(30) Foreign Application Priority Data

Jun. 28, 2002 (DE) ..... 102 29 005

(51) Int. Cl.[7] ..... C25D 21/12; C25D 5/00

(52) U.S. Cl. ..... 205/81; 205/82; 205/83; 205/96

(58) Field of Search ..... 205/96, 81, 82, 205/83

(56) References Cited

U.S. PATENT DOCUMENTS 5,472,592 A 12/1995 Lowery
6,004,440 A * 12/1999 Hanson et al. ..... 204/279
6,322,674 B1 11/2001 Berner et al.
6,444,101 B1 * 9/2002 Stevens et al. ..... 204/224 R
6,500,317 B1 * 12/2002 Yoshioka et al. ..... 204/228.7

* cited by examiner

*Primary Examiner*—Wesley A. Nicolas
(74) *Attorney, Agent, or Firm*—Williams, Morgan & Amerson, P.C.

(57) ABSTRACT

In an electroplating apparatus for semiconductor wafers, the currents to each of a plurality of contact portions contacting the wafer edge are individually adjustable and/or a parameter indicative of the current flow in each contact portion may be determined. Moreover, for precise control of the currents, means are provided for monitoring the currents.

15 Claims, 6 Drawing Sheets

APPARATUS AND METHOD FOR ELECTROCHEMICAL METAL DEPOSITION

BACKGROUND OF THE INVENTION

1. Field of the Invention

The present invention relates to the field of fabrication of integrated circuits, and, more particularly, to the field of electroplating metal layers on workpieces suitable for the fabrication of integrated circuits, such as, for example, silicon wafers.

2. Description of the Related Art

In recent years, many efforts have been made in the art to develop methods and apparatuses for forming a layer of an electrically-conductive material filling a plurality of spaced-apart recesses formed in the surface of a substrate, wherein the exposed upper surface of the layer is substantially coplanar with non-recessed areas of the substrate surface. More particularly, methods and/or apparatuses have been developed in the art for performing "back-end" metallization of semiconductor high-speed integrated circuit devices having sub-micron dimensional design features and high conductivity interconnect features, wherein an attempt is made to achieve the complete filling of the recesses while facilitating subsequent planarization of the metallized surface by chemical mechanical polishing (CMP), increasing manufacturing throughput and improving product quality.

A commonly-employed method for forming metallization patterns such as are required for metallization processing of semiconductor wafers employs the so-called "damascene" technique. Generally, in such a process, recesses for forming metal lines for electrically connecting horizontally separated devices and/or circuits are created in a dielectric layer by conventional photolithography and etching techniques, and filled with metal, typically aluminum or copper. Any excess metal on the surface of the dielectric layer is then removed by, e.g., chemical mechanical polishing techniques, wherein a moving pad is biased against the surface to be polished, with a slurry containing abrasive particles (and other ingredients) being interpositioned therebetween.

FIGS. 1*a*–1*c* schematically show, in a simplified cross-sectional view, a conventional damascene process sequence employing electroplating and CMP techniques for forming metallization patterns (illustratively of copper-based metallurgy but not limited thereto) on a semiconductor substrate 1. In FIG. 1*a*, a dielectric layer 3 with a surface 4 is located on the substrate 1 with a recess or trench 2 formed therein. An adhesion/barrier layer 7 and a nucleation/seed layer 8 are formed on the dielectric layer 3.

A typical process flow may include the following steps. In a first step, the desired conductive pattern is defined as the recess or trench 2 formed (as by conventional photolithography and etching techniques) in the surface 4 of the dielectric layer 3 (e.g., a silicon oxide and/or nitride or an organic polymeric material) deposited or otherwise formed over the semiconductor substrate 1. Next, the adhesion/barrier layer 7 comprising, e.g., titanium, tungsten, chromium, tantalum or tantalum nitride, and the overlying nucleation/seed layer 8, (usually copper, or copper-based alloy) is subsequently deposited by well-known techniques, such as physical vapor deposition (PVD), chemical vapor deposition (CVD) and plasma enhanced chemical vapor deposition (PECVD).

FIG. 1*b* shows the substrate 1 after deposition of the bulk metal layer 5 of copper or copper-based alloy by conventional electroplating techniques to fill the recess 2. In order to ensure complete filling of the recess, the metal layer 5 is deposited as a blanket or overburden layer of excess thickness so as to overfill the recess 2 and cover the upper surface 4 of the dielectric layer 3. Next, the entire excess thickness of the metal layer 5 over the surface 4 of the dielectric layer 3, as well as the layers 7 and 8, are removed by a CMP process.

FIG. 1*c* shows a metal portion 5' in the recess 2 with its exposed upper surface 6 substantially coplanar with the surface 4 of the dielectric layer 3 as a result of the CMP process.

FIG. 2 shows, in a simplified manner, a typical electroplating reactor 9 that may be used to form the metal layer 5. The electroplating reactor 9 comprises a reaction chamber 10 adapted for containing an electroplating fluid 11. A substrate holder 15 is configured to hold the substrate 1 facedown in the reaction chamber 10. One or more contacts 12 are provided to connect the substrate surface to a plating power supply 13. An anode 14 is disposed in the chamber 10 and is connected to the plating power supply 13. For the sake of simplicity, means for establishing a fluid flow and a diffuser, as typically used in fountain-type reactors, are not shown in FIG. 2. The substrate holder 15 and/or the anode 14 may be rotatable about an axis 1'. Of course, reactors other than the reactor 9 depicted in FIG. 2 may be used for the purpose of electroplating the metal layer 5. For instance, reactors may be used in which the electroplating fluid is sprayed on the wafer or reactors may be used in which the wafer is immersed in an electroplating bath.

In operation, a voltage is applied between the anode 14 and the substrate 1 via the contacts 12, wherein current paths form from the anode 14 via the fluid 11, the surface of the substrate 1, i.e., the seed layer 8, and the contacts 12 to the power supply 13. Among others, the deposition rate, at specific areas of the substrate 1, depends on the amount of current flowing in each of the current paths defined by the individual contacts 12.

The damascene technique as explained above with reference to FIGS. 1*a*–1*c* suffers from several drawbacks, at least some of which are caused by the non-uniformity of the metal layer 5.

Shown in FIG. 3*a* is the typical situation at the end of a prior art electroplating process. As is apparent from FIG. 3*a*, the thickness of the metal layer 5 may notably vary. This is particularly disadvantageous when different portions of the substrate 1 including trenches 2*a* and 2*b* are covered by a layer having a non-uniform thickness. The non-uniformity of the metal layer 5 may result in a degradation of the metal trenches 2*a*, 2*b* in the subsequent CMP process.

As shown in FIG. 3*b*, if the CMP process is stopped as soon as the portions of the metal layer 5 at the trenches 2*b* are removed, residuals of the layer 5 are left on the substrate 1 and may cause shorts or leakage currents between the metal lines 2*a*. As shown in FIG. 3*c*, if, on the other hand, the CMP process is carried out until the portions of the layer 5 having greater thickness are removed and no metal residuals are left on the substrate, the metal in the metal lines 2*b* will be removed in excess. Accordingly, the cross-sectional dimensions of the metal lines 2*b* would be decreased, thereby adversely affecting the electrical and thermal conductivity of the metal lines 2*b*.

Since the CMP process may also exhibit an "intrinsic" non-uniformity, which may contribute to the total degree of non-uniformity, the situation described above may become even worse and require a high degree of "safety" margins in the design rules.

Accordingly, in view of the problems explained above, it would be desirable to provide an electroplating method and apparatus that may solve or reduce one or more of the problems identified above. In particular, it would be desirable to provide a method and an apparatus for electroplating layers of conductive material on workpieces, thereby insuring a high controllability of the deposition process.

SUMMARY OF THE INVENTION

In particular, the present invention is based on the consideration that it is essential to monitor the individual current paths to obtain information about the uniformity of the plating process. Moreover, according to the inventors' finding, layers of a conductive material exhibiting a high degree of uniformity over the whole substrate surface can be electroplated by contacting the wafer at different positions and supplying current separately to each of the contacts contacting the substrate. The current supplied to each contact determines the metal deposition rate according to Faraday's law. For example, by providing each contact with substantially the same current, substantially identical growth rates in the vicinity of the contacts may be obtained. Moreover, increasing the number of contacts will allow more precise control of the growth rates. On the other hand, the currents in the plural current paths may individually be controlled in accordance with a desired current for each of the current paths to generate a desired deposition profile across the substrate surface, or by individually controlling the currents, hardware non-uniformities, such as different distance between adjacent contact areas, different size of the contact areas, and the like, may be compensated for.

According to one embodiment, the present invention relates to a method of electroplating a layer of an electrically conductive material on a workpiece, the method comprising supplying electrical current to the workpiece through a plurality of contact portions contacting the workpiece at corresponding different locations. The method further comprises adjusting the current in at least some of the contact portions.

According to another embodiment, the present invention relates to a method of electroplating a layer of an electrically-conductive material on a workpiece, comprising supplying electrical current to the workpiece through a plurality of contacting lines contacting the workpiece at corresponding different locations. The method further comprises determining a parameter in at least some of the contacting lines that is indicative of the current in the contacting lines.

According to a further illustrative embodiment of the present invention, an electroplating apparatus for electroplating a layer of an electrically conductive material on a workpiece comprises a plurality of contact portions for supplying current to the workpiece, wherein the contact portions are adapted to be brought into contact with the workpiece at corresponding different locations. The apparatus further comprises a measuring device configured to measure a parameter indicative of a current flowing in at least some of the contact portions.

BRIEF DESCRIPTION OF THE DRAWINGS

The invention may be understood by reference to the following description taken in conjunction with the accompanying drawings, in which like reference numerals identify like elements, and in which.

Figure 1A:
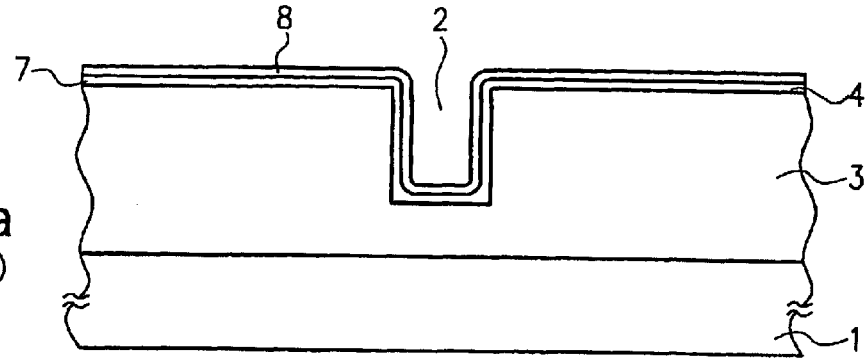
Fig.1a (Prior Art)
FIGS. 1*a*–1*c* represent a typical prior art damascene technique for forming conductive patterns on wafers.
Figure 1B:
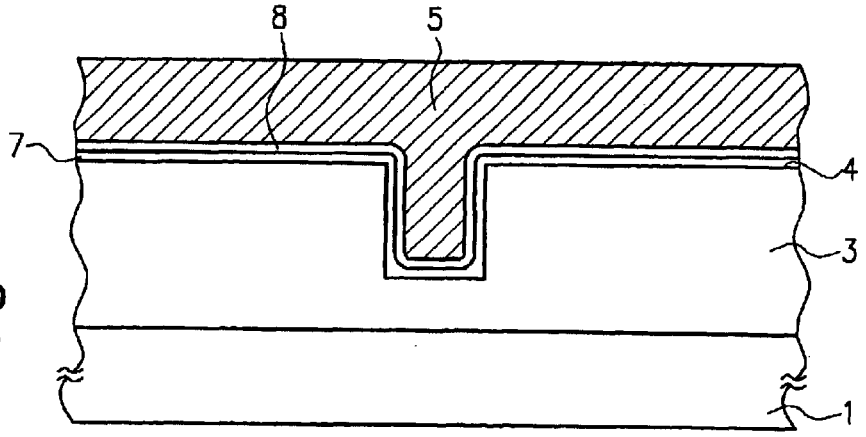
Fig.1b (Prior Art)
Figure 1C:
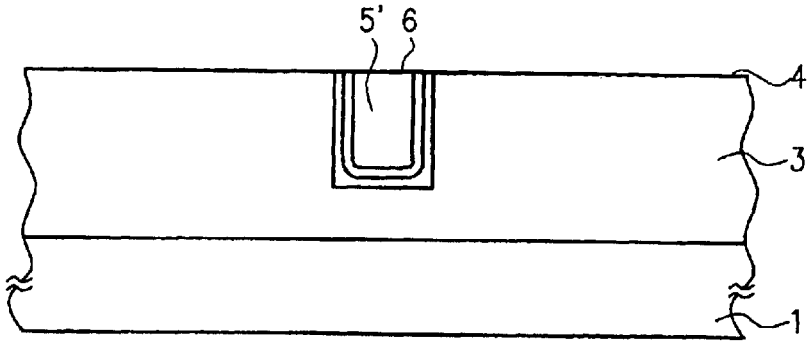
Fig.1c (Prior Art)
Figure 2:
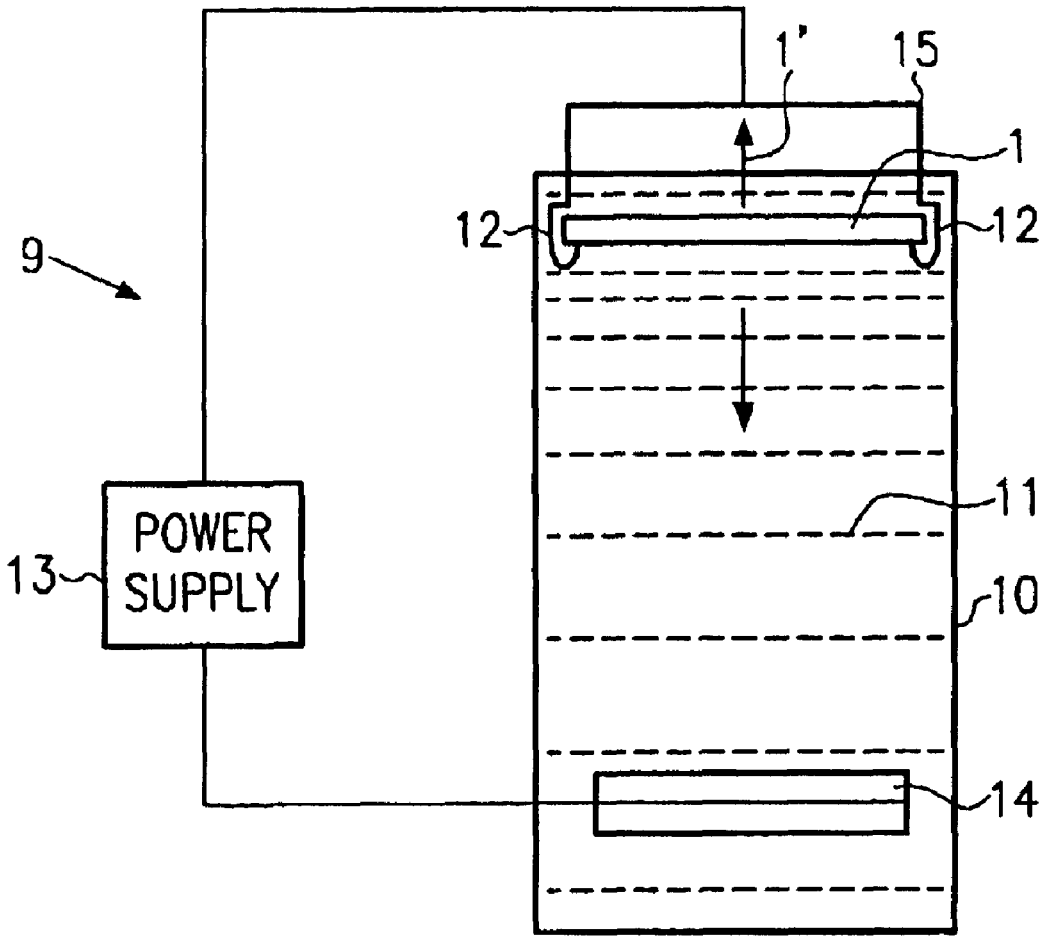
Fig.2 (Prior Art)
FIG. 2 schematically represents a typical prior art electroplating apparatus adapted for electroplating layers of a conductive material on workpieces.
Figure 3A:
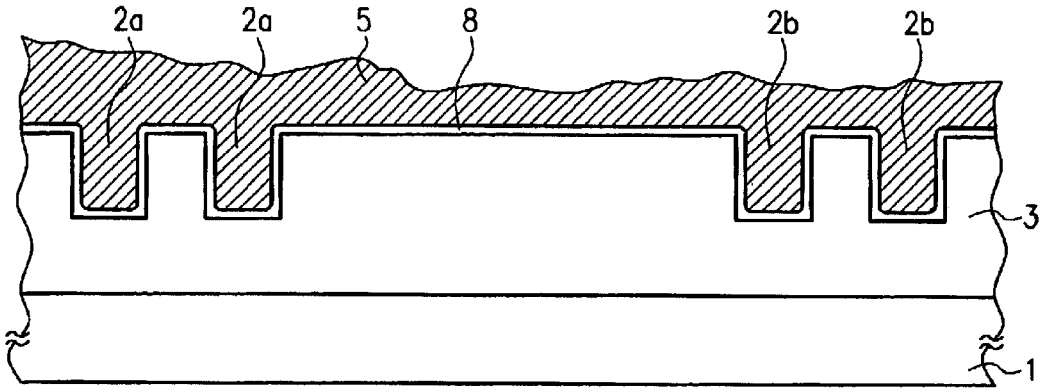
Fig.3a (Prior Art)
FIGS. 3*a*–3*c* depict typical problems arising when a prior art electroplating method and apparatus is used for electroplating layers of conductive material on workpieces.
Figure 3B:
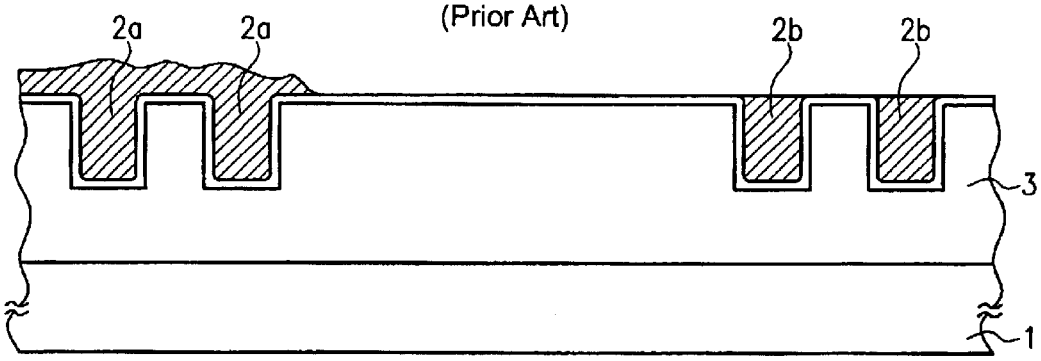
Fig.3b (Prior Art)
Figure 3C:
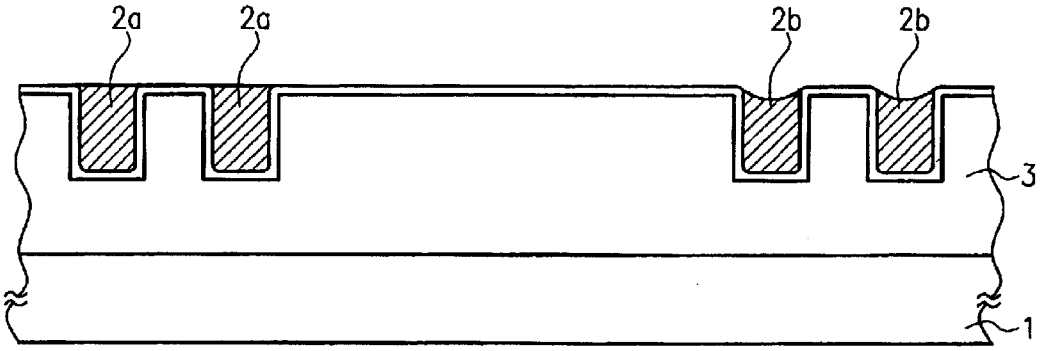
Fig.3c (Prior Art)

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention is understood to be particularly advantageous when used in combination with a damascene technique for forming conductive lines on the surface of a wafer during the manufacturing of semiconductor devices. For this reason, examples will be given in the following in which corresponding embodiments of the present invention are described with reference to electroplating layers of conductive material on the surface of a wafer. However, it has to be noted that the present invention is not limited to the particular case of metal layers electroplated on silicon wafers, but can be used in any other situation in which the realization of metal layers is required.

Figure 4A:
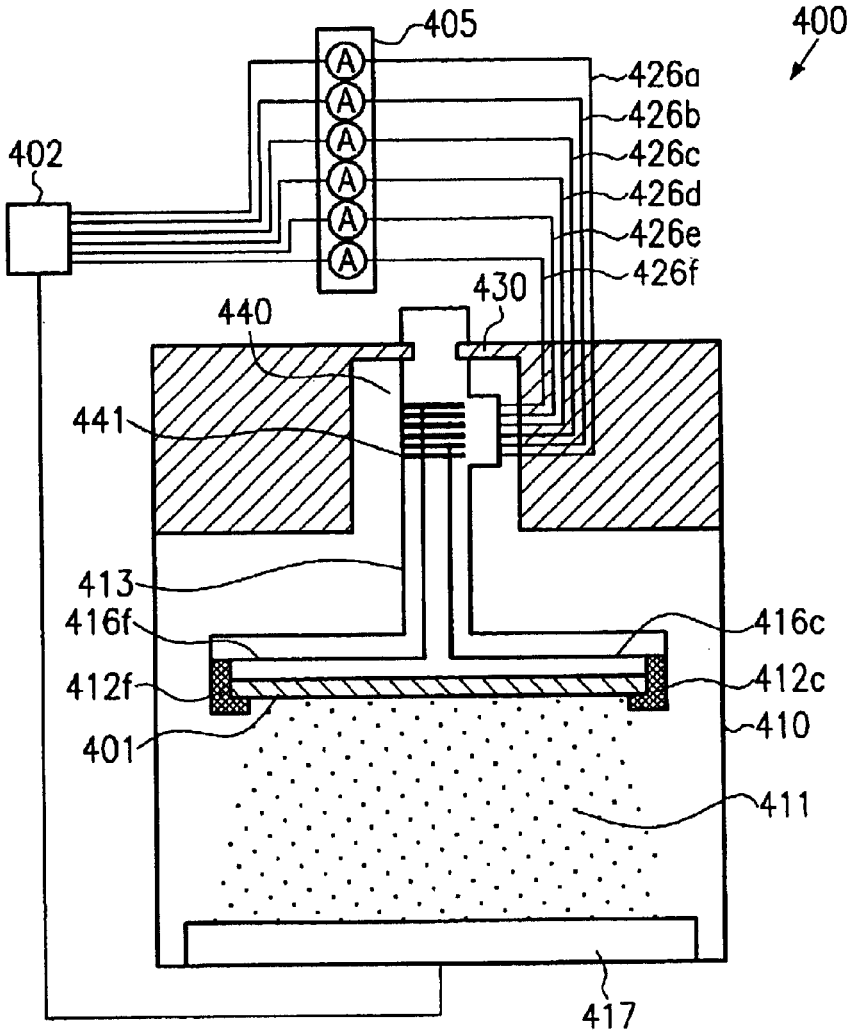
FIGS. 4*a* and 4*b* schematically show a plating reactor with a rotatable substrate holder and means for individually impressing voltage or current into a plurality of contact lines according to one illustrative embodiment of the present invention.
Figure 4A:
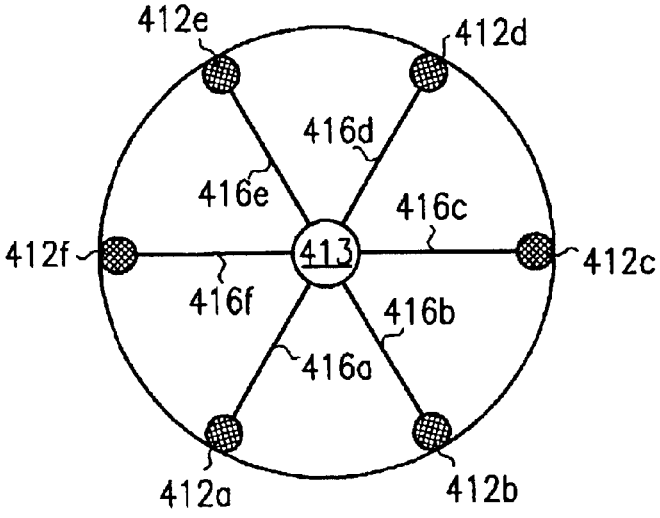

In FIG. 4*a*, one illustrative embodiment of a plating reactor 400 of the present invention is shown in a simplified manner. The reactor 400 is meant to represent any type of plating reactor, such as bath reactors, fountain-type reactors, spray reactors, and the like, used for depositing metal, such as copper. The reactor 400 comprises a chamber 410 adapted to receive and contain an electrolyte 411. A substrate holder 413 is rotatably supported by a bearing section 430. The substrate holder 413 comprises a plurality of contacts 412*a*–412*f* that are electrically conductive and are, according to one embodiment, made of a material, such as platinum, that substantially withstands the electrolyte 411. The contacts 412*a*–412*f* are arranged and configured to hold and electrically contact a substrate 401 at the edge thereof.

The lower portion of FIG. 4*a* depicts a bottom view of the substrate holder 413 with the contacts 412*a*–412*f* located at the periphery of the substrate holder 413 and with contact lines 416*a*–416*f* connected with the contacts 412*a*–412*f*. The contacts 412*a*–412*f* are connected via the corresponding contact lines 416*a*–416*f* to a terminal portion 440 that is configured to provide electrical contact from the rotatable contact lines 416*a*–416*f* to a plurality of stationary contact lines 426*a*–426*f*. In one embodiment, the terminal portion 440 may comprise a plurality of ring-shaped slide contacts 441 and a corresponding plurality of wipers 442 each engaging a respective slide contact 441.

Figure 4B:
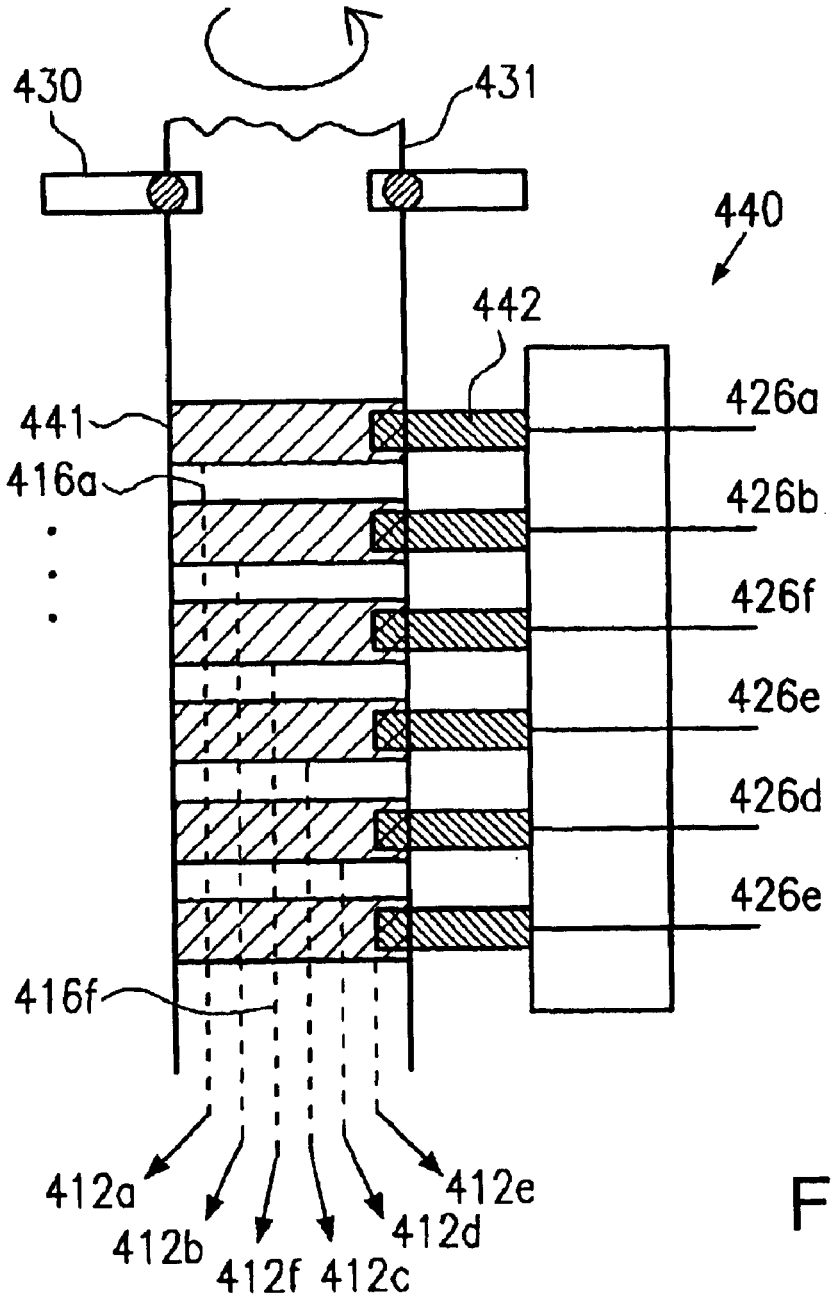

FIG. 4*b* schematically shows an enlarged view of the terminal portion 440. The contact lines 416*a*–416*f* provide electrical contact between the slide contacts 441 and the contact portions 412*a*–412*f*. The contact portions 412*a*–412*f* may be arranged inside a shaft 431 of the substrate holder 413 such that they are insulated from each other and from the slide contacts 441.

Again referring to FIG. 4*a*, the stationary contact lines 426*a*–426*f* are connected to a power supply 402 via a measurement unit 405. An electrode 417, which will for convenience in the following be referred to as an anode, is connected to the power supply 402.

In operation, the power supply 402 applies an appropriate voltage to each of the contact lines 426*a*–426*f* to initiate individual plating currents flowing via the contact lines 426*a*–426*f*, the terminal portion 440, the contact lines 416*a*–416*f*, the contacts 412*a*–412*f*, the seed layer (not shown) of the substrate 401, the electrolyte 411 and the anode 417 back to the power supply 402. The electroplating rate is a direct function of the current density supplied to the contacts 412*a*–412*f*. If, therefore, the contacts 412*a*–412*f* are substantially uniformly distributed on the substrate edge, a substantially equal current may be supplied to the contacts 412*a*–412*f* to obtain a substantially uniform plating rate at each of the contacts 412*a*–412*f*. On the other hand, the currents through the contacts 412*a*–412*f* may be controlled so as to obtain a required deposition rate at the vicinity of each of the contacts 412*a*–412*f* and, thus, a "geometrical" non-conformity, i.e., differing distances between neighboring contacts 412*a*–412*f*, may be compensated for by correspondingly adjusting the currents.

In one illustrative embodiment, "reference current patterns" may be established, for example, by running one or more substrates and determining the final deposition profile to obtain the current pattern providing an optimum profile. The current pattern does not need to be constant in time and may vary during the plating process. By employing these reference current patterns to control the currents in each of the contacts 412*a*–412*f*, any hardware non-uniformity may automatically be compensated for.

In some embodiments, the measuring unit and/or the power supply 402 may be configured to detect the voltage that is required to impress the respective plating current in each of the contacts 412*a*–412*f*. In this way, any irregularities in the plating process, for example, occurring in the form of hardware drifts, and the like, may immediately be recognized and be taken into account. For example, an excessive raise or decrease of the voltage in one of the contact lines may indicate a malfunction of the plating reactor 400.

The controlling of the currents may be accomplished by various means that are well-known in the art. For instance, the power supply 402 may comprise a plurality of adjustable constant current sources including a feedback loop to continuously adjust the current according to the reference current pattern. In one simple embodiment, the power supply 402 may include constant current sources that may manually be adjusted to provide respective time-constant currents so that the deposition rate is also constant in time, wherein the deposition rates at different contacts 412*a*–412*f* do not necessarily have to be equal. In other embodiments, the power supply may include a control unit (not shown) that allows an automated control of the currents according to any desired reference current pattern.

In addition, to impress a specified current in each of the contact lines 426*a*–426*f*, a specified voltage may be applied and the resulting current may be monitored by means of the measuring unit 405. To this end, the measuring unit 405 may include current sensors as are well-known in the art, for example, magnetic field sensors, resistors to determine the current via the voltage drop, and the like. By operating the reactor 400 in a voltage driven mode, any irregularities may be detected by a change of the corresponding current.

It is to be appreciated that the concept of individually operating and/or monitoring the voltages and or currents supplied to the substrate 401 encompasses all types of operational modes of the electroplating reactor 400. Thus, irrespective of whether a DC plating, a forward pulse mode, a forward-reverse pulse plating mode, electropolishing mode, and the like is selected, an increased stability of the plating process and/or an improved uniformity and/or a required deposition profile may be obtained in accordance with the present invention.

It is further to be noted that although six contacts 412*a*–412*f* are shown in the above embodiments, any number of contacts 412*a*–412*f* (with a corresponding number of contact lines 416, 426), may be selected. Even with four contacts 412, a significant improvement of process control is achieved compared to conventional four contact devices. By providing a larger number of contacts 412, the precision of the deposition process may be enhanced. Preferably, when using a high number of separately driven contacts 412, the power supply 402 and/or the measuring unit 405 include a control unit that is configured to handle the corresponding measurement and drive signals in a time-efficient manner. For instance, the power supply 402 and/or the measuring unit 405 may comprise a digital circuit for obtaining, processing and supplying measurement signals, control and drive signals.

In the embodiments described above, the terminal portion 440 allows one to individually connect the contacts 412*a*–412*f* with the power supply 402 via the measuring device 405. In some embodiments, it may be desirable to modify already existing plating reactors to achieve a superior process control compared to conventional reactors.

Figure 5A:
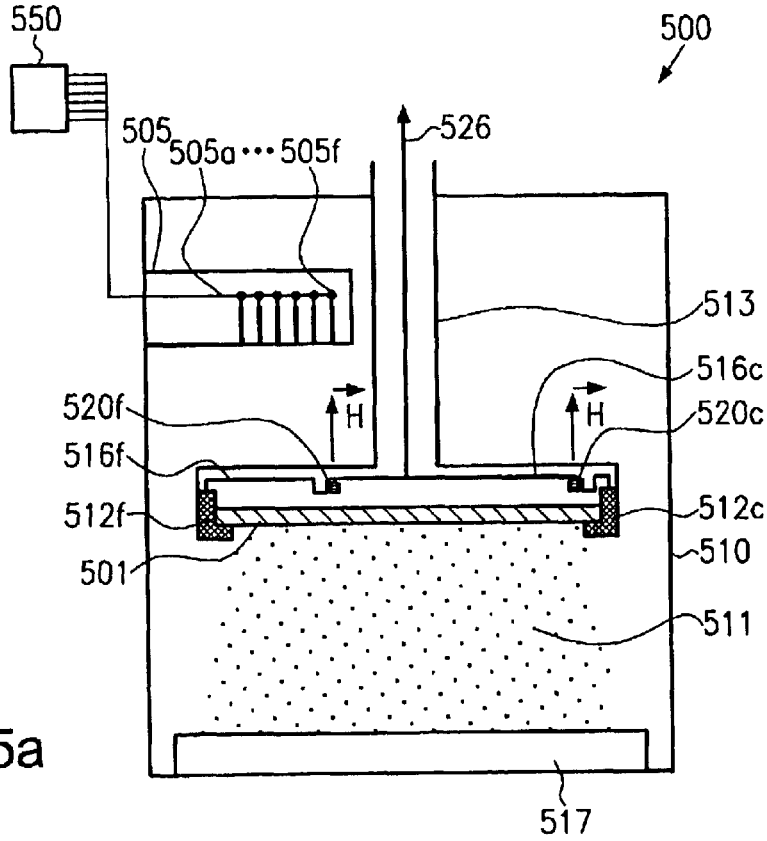
FIGS. 5*a* and 5*b* schematically show a further plating reactor that requires minor modification to allow a superior process control according to another illustrative embodiment of the present invention.
Figure 5B:
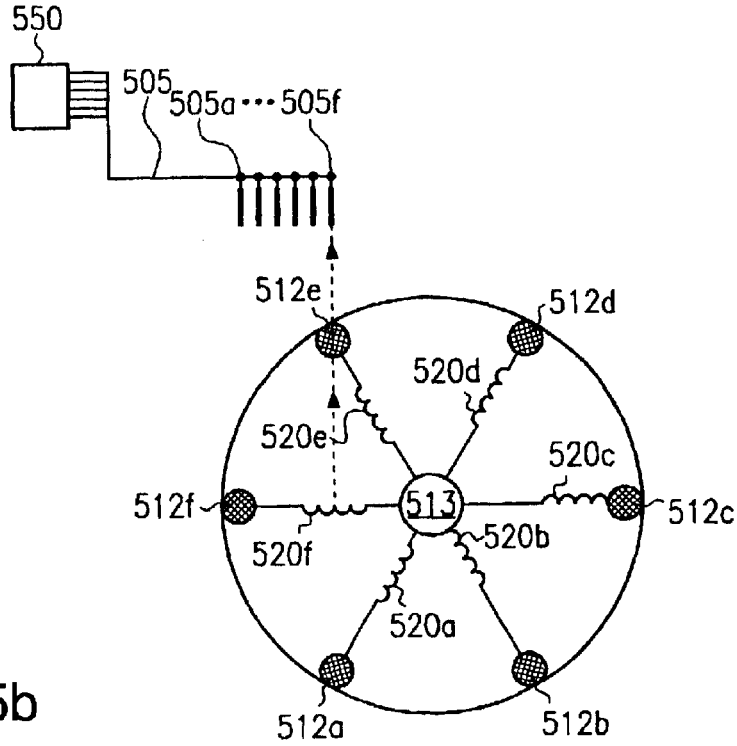

With reference to FIGS. 5*a* and 5*b*, further illustrative embodiments of the present invention will now be described. In FIG. 5*a*, components and parts equivalent or similar to those depicted in FIG. 4*a* are denoted by the same reference signs except for a leading "5" instead of a leading "4." A detailed description of these parts will be omitted. The reactor 500 is devoid of a terminal portion and the contact lines 516*a*–516*f* are connected to a power line 526 connected to the power supply as in conventional apparatuses. Thus, no modification of these parts of a conventional reactor is necessary. The contact lines 516*a*–516*f* are connected to the contacts 512*a*–512*f* that may be configured in a similar way as the contacts 412*a*–412*f*. A stationary measuring device 505 is attached to the chamber 510 and may comprise a plurality of non-contact current sensors 505*a*–505*f*, for example, magnetic field sensors, such as Hall-elements. In each of the contact lines 516*a*–516*f*, a coil 520*a*–520*f* is provided and arranged to create a magnetic field, as indicated by the vector H. The location of the coils 520*a*–520*f* may differ in the radial position in such a way that the radial position of each coil 520*a*–520*f* corresponds to the position of one of the current sensors 505*a*–505*f*. The current sensors 505*a*–505*f* are connected to a control unit 550. FIG. 5*b* schematically shows the arrangement of the current sensors 505*a*–505*f* and the coils 520*a*–520*f* in more detail.

In operation, the substrate holder 513 rotates the substrate 501 while the power supply impresses current or voltage or suitable pulses via the contact line 526 into the contact lines 516*a*–516*f* so as to initiate a plating current in each of the contact lines 516*a*–516*f*. Whenever the coils 520*a*–520*f* pass the corresponding current sensor 505*a*–505*f*, a signal is generated that represents the current flowing in the respective contact line 516*a*–516*f*. These signals are delivered to the control unit for further processing. From these signals, the progress of the plating process may be monitored in a similar way as is described with reference to FIGS. 4*a* and 4*b*.

In another embodiment, a single current sensor 505*a* may be provided and the coils 520*a*–520*f* may be arranged at the same radial position, wherein a counter may identify the measurement signals output by the single current sensor 520*a*. In a further embodiment, the coils may not be necessary and the single current sensor may directly measure the magnetic field created within the contact lines 516*a*–516*f*.

In embodiments without rotation of the substrate 501, the current sensors may be positioned over a respective contact line 516*a*–516*f* or a respective coil 520*a*–520*f* if provided. Moreover, in this stationary arrangement, resistor elements may be used instead of or in addition to the coils 520*a*–520*f*. If only resistor elements are provided, the current may be readily detected by measuring the voltage drop across the respective resistor element. To this end, the control unit may be adapted to determine the voltage drop across each resistor element, or additional voltage measurement devices may be provided for each resistor. By providing the resistor elements as adjustable resistors or by providing additional adjustable resistors in each of the contact lines 516*a*–516*f*, the current in each of the contact lines may be easily controlled by correspondingly adjusting the adjustable resistors. Thus, in the non-rotational arrangement of the reactor 500, the currents in the contact lines 516*a*–516*f* may efficiently be measured and controlled without requiring substantial modification of the reactor 500.

In a rotational reactor 500, the current sensor(s) 505*a*–505*f* allow an efficient monitoring of the plating currents and, thus, of the process, without substantial modification of the conventional rotational reactor.

In order to obtain superior control of the plating process, the control unit may be configured, by means of appropriate analog and/or digital circuitry, to perform the measurement and possibly the adjustment of resistor elements in an automated manner. In other embodiments, it may be appropriate, however, to have an operator to analyze the measurement signals and possibly adjust the plating currents in the contact lines 516*a*–516*f*. Moreover, the electroplating process and the reactors described above may readily be implemented in existing process flows for manufacturing semiconductor devices without adding costs and/or complexity, since presently-available plating systems may be readily completed in accordance with the embodiments described above.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method of electroplating a layer of an electrically-conductive material on a workpiece, comprising:

supplying electrical current to the workpiece through a plurality of contact portions contacting the workpiece at corresponding different locations;

measuring a magnetic field of each of said plurality of contact portions to determine a magnitude of said current in each of said contact portions; and individually adjusting a current in at least two of said contact portions.

2. The method of claim 1, wherein said contact portions are arranged to substantially uniformly contact the workpiece at the edge thereof.

3. The method of claim 2, wherein said workpiece is a semiconductor wafer suitable for the manufacture of integrated circuits having formed thereon a metal seed layer and said plurality of contact portions contact said seed layer.

4. The method of claim 1, wherein the currents in the contact portions are adjusted so as to obtain substantially equal current flow through each of the plurality of contact portions.

5. The method of claim 1, wherein said workpiece is rotating during depositing of the conductive material.

6. The method of claim 1, further comprising establishing a reference current for each of the contact portions.

7. The method of claim 6, wherein the currents in each of the contact portions are controlled on the basis of the reference currents.

8. The method of claim 1, further comprising monitoring at least one of a current and a voltage impressed into the contact portions to detect irregularities of the plating process.

9. A method of electroplating a layer of an electrically-conductive material on a workpiece, comprising:

supplying electrical current to the workpiece through a plurality of contacting lines contacting the workpiece at corresponding different locations; and determining the current in each of said contacting lines, wherein a magnetic field of each of said contacting lines is measured.

10. The method of claim 9, wherein at least one resistor is provided in each of said contacting lines.

11. The method of claim 9, wherein a coil is provided in each of the contacting lines creating said magnetic field indicative of the current in the contacting line.

12. The method of claim 9, wherein said workpiece is rotating.

13. The method of claim 9, wherein the currents in the contacting lines are adjusted so as to obtain a substantially equal current flowing through each of the plurality of contacting lines.

14. The method of claim 9, further comprising establishing a reference current for each of the contact lines.

15. The method of claim 14, wherein the currents in each of the contact lines are controlled on the basis of the reference currents.

* * * * *